United States Patent [19]

Egli et al.

[11] Patent Number: 4,556,767

[45] Date of Patent: Dec. 3, 1985

[54] GAS-BLAST CIRCUIT BREAKER

[75] Inventors: Walter Egli, Baden; Klaus Ragaller; Ekkehard Schade, both of Wettingen; Roland Stelzer, Würenlos, all of Switzerland

[73] Assignee: BBC Brown, Boveri & Company, Ltd., Switzerland

[21] Appl. No.: 614,866

[22] Filed: May 29, 1984

[30] Foreign Application Priority Data

May 31, 1983 [CH] Switzerland ..... 2968/83

[51] Int. Cl.[4] ..... H01H 33/88

[52] U.S. Cl. ..... 200/148 A; 200/148 R

[58] Field of Search ..... 200/148 A, 148 R

[56] References Cited

U.S. PATENT DOCUMENTS

| | | | |
|---|---|---|---|
| 2,913,559 | 11/1959 | Cromer | 200/148 A |
| 3,331,935 | 7/1967 | Milianowicz | 200/148 A |
| 3,914,569 | 10/1975 | McConnell et al. | 200/148 A |
| 4,103,131 | 7/1978 | Graf et al. | 200/148 A |
| 4,445,018 | 4/1984 | Holmgren | 200/148 A |

*Primary Examiner*—Robert S. Macon

*Attorney, Agent, or Firm*—Ostrolenk, Faber, Gerb & Soffen

[57] ABSTRACT

A gas-blast breaker with two contact members which are movable relative to one another. Each contact member is provided with a respective sparking contact. The contacts communicate with a cylindrical compression chamber whose volume varies as a function of the movement of the contact members and which is filled pressurized gas. A channel leading into a quenching zone between the sparking contacts extends into a first one of the two end faces of the compression chamber. A second one of the two end faces is bounded by a piston which is displaceable along the cylinder axis of the compression chamber and which is subjected to the action of a tensioned spring. The circuit breaker is suited for reliably interrupting both small and large currents, with a comparatively weak and simple drive mechanism for the movable contact member. The piston interacts with a fixed stop which is arranged such that the movement of the piston which is subjected to the action of the tensioned spring is blocked, below a predetermined first gas pressure in the compression chamber, against the movement of one of the contact members which is moved upon the occurrence of a breaking operation in the circuit breaker.

14 Claims, 4 Drawing Figures

GAS-BLAST CIRCUIT BREAKER

BACKGROUND OF THE INVENTION

The invention relates to a gas-blast circuit breaker. A circuit breaker of this type is known for instance from U.S. Pat. No. 3,331,935. The known circuit breaker has a movable contact member cooperating with a stationary contact member and having a first piston which, on breaking, is moved along the inner wall of a cylinder to thus compress insulating gas present in the cylinder. A second piston which, on breaking, is moved by a tensioned spring in the opposite direction towards the first piston additionally enhances the compression of the insulating gas present in the cylinder at the start of the breaking process, whereby the breaking capacity under large currents is improved. The spring providing the driving force for the second piston must therefore be designed to handle large forces. In addition, the second piston must be released by an expensive catch system at the start of the breaking process.

SUMMARY OF THE INVENTION

It is the object of the present invention to provide a circuit breaker of the generic type, which can reliably interrupt both small and large currents and which is comparatively small and has a simple drive design for the movable contact member.

This object is achieved by the features given in the characterising clause of Patent Claim 1. The circuit breaker according to the invention is distinguished by the fact that, in spite of a rather small size of the drive for the movable contact member, it has quantities of quenching gas available at a suitable pressure, which are sufficient for quenching both large and small switching arcs and are released according to the switching arc characteristics that are to be quenched.

BRIEF DESCRIPTION OF THE DRAWINGS

Illustrative embodiments of the subject of the invention are represented below by reference to the drawing in which.

DETAILED DESCRIPTION OF PREFERRED EMBODIMENTS

Figure 1:
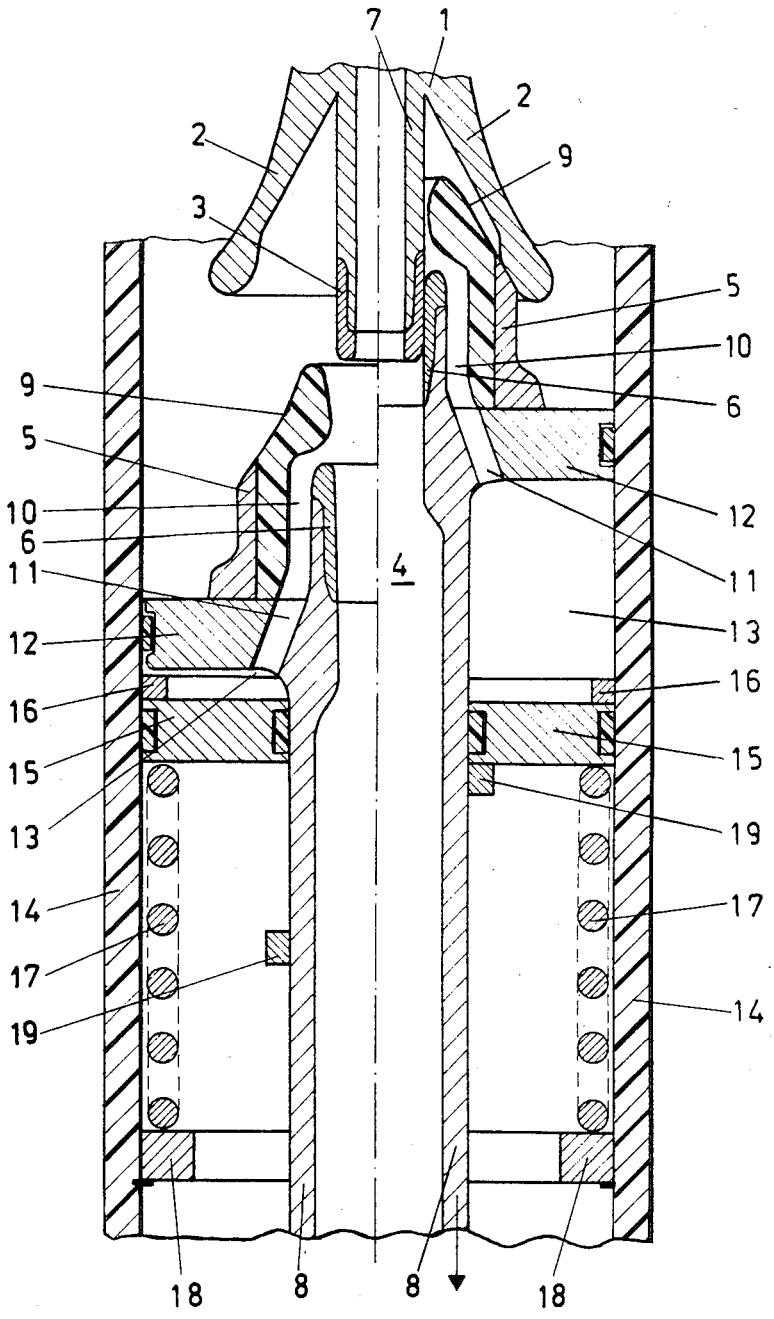
FIG. 1 is a plan section through a first embodiment of the gas-blast circuit breaker according to the invention.
Figure 3:
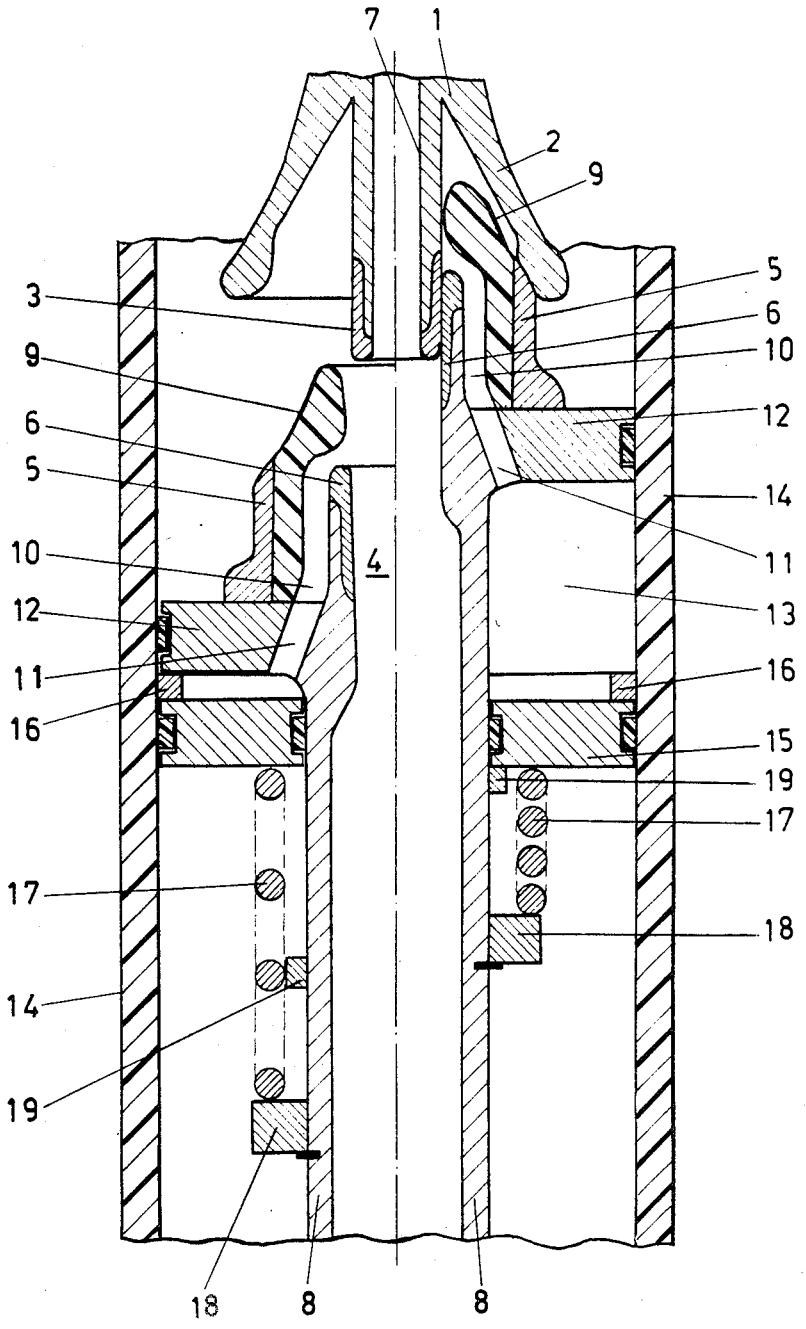
FIG. 3 is a plan section through a second embodiment of the gas-blast circuit breaker according to the invention.
Figure 4:
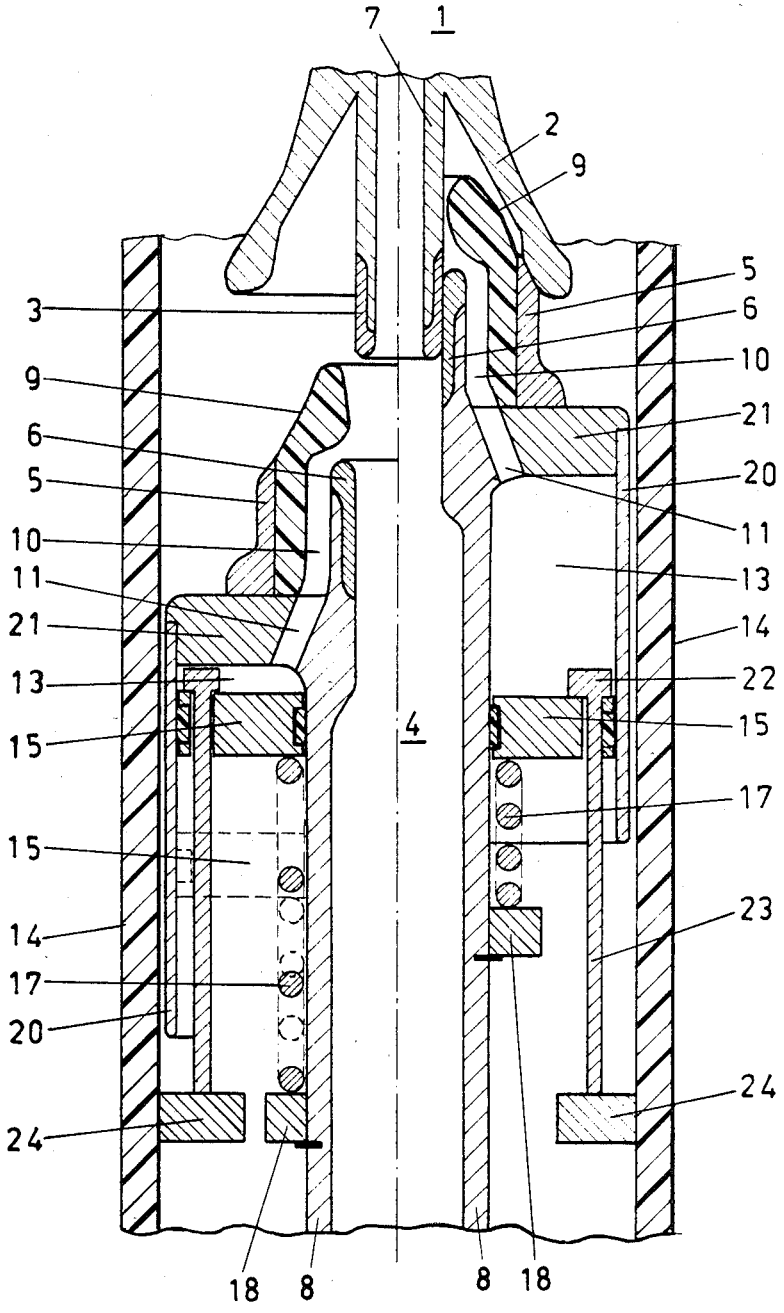
FIG. 4 is a plan section through a third embodiment of the gas-blast circuit breaker according to the invention.

The gas-blast circuit breakers according to the invention, illustrated in FIGS. 1, 3 and 4, are shown in the break-position in the left-hand half of each figure, and in the make-position in the right-hand half of each figure. In the Figures, identical parts are identified by identical reference symbols.

The gas-blast circuit breaker shown in FIG. 1 has a stationary contact member 1 with a rated-current contact 2 and a sparking contact 3 as well as a movable contact member 4 with a rated-current contact 5 and a sparking contact 6. The sparking contacts 3 and 6 have the shape of nozzles and each is fitted on contact tubes

7 and 8. The sparking contact 3 of the stationary contact member 1 has an external diameter which approximately corresponds to the internal diameter of the nozzle-shaped sparking contact 6 of the movable contact member 4, so that, in the make-position, the sparking contact 3 can penetrate into the interior of the sparking contact 6 (shown in the right-hand half of FIG. 1).

The sparking contact 6 of the movable contact member 4 is surrounded at a distance by a nozzle 9 of insulating material. The outer surface of the nozzle 9 of insulating material is bounded by the rated-current contact 5. The inner surface of the nozzle 9 of insulating material, together with the outer surfaces of the contact tube 8 and sparking contact 6, defines an annular channel 10 which extends through an annular piston 12 which is fixed by means of webs 11 to the contact tube 8. In the break-position (right-hand half of FIG. 1), the channel 10 connects the zone, which is located between the two sparking contacts 3 and 6 and in which, during a switching process, a switching arc develops between the sparking contacts 3 and 6 burns, to a compression chamber 13.

The compression chamber 13 is bounded by a cylindrical housing 14, which receives the contact members 1 and 4 and which comprises an insulating material, such as glass fibre-reinforced plastic or porcelain, the contact tube 8, the piston 12 and a further piston 15. The two pistons 12 and 15 can slide in the axial direction on the inner surface of the housing 14, in a sealing fashion. On the inner surface of the housing 14, an annular stop 16 is fitted and the surface of the piston 15 which faces the compression chamber 13 bears against this stop. A compression spring 17, of which the end remotely located from the piston 15 is held on a shoulder 18 of the inner surface of the housing 14, is supported on the surface of the piston 15 remotely located from the compression chamber 13. On the contact tube 8, a stop 19 is provided, the surface of the piston 15 remote from the compression chamber 13 bearing against this stop in the make-position. The piston 15 therefore acts in the make-position like a solid bottom of the compression chamber 13. The housing 14 is filled with an insulating gas, such as sulphur hexafluoride, preferably at a pressure of a few bars.

On breaking, the contact tube 8 is moved by a drive (not shown) in the direction of the arrow shown in the right-hand half of FIG. 1, namely downwards. As a result, initially the rated-current contact 2 and 5 open, the current which is to be switched off is commutated into a current path comprising the contact tube 7, the sparking contact 3, the sparking contact 6 and the contact tube 8. A few milliseconds later, the sparking contacts 3 and 6 are disengaged and a switching arc (not shown) is ignited between these contacts.

Because of the simultaneous downward movement of the piston 12, the pressure of the insulating gas enclosed in the compression chamber 13 is increased and pressurised gas flows, upon separation of the contacts, from the chamber 13 via the channel 10 into the zone between the two sparking contacts 3 and 6, which blasts onto the switching arc. After the blast, the gas which flows in is discharged via the nozzle-shaped sparking contacts 3 and 6 and the contact tubes 7 and 8 as well as the nozzle 9 of insulating material into an expansion chamber. The spring 17 is dimensioned in such a manner that the piston 15, in spite of the increasing pressure of the insulating gas present in the compression chamber 13, is forced against the stop 16 at least until the time when the sparking contacts 3 and 6 are separated.

Figure 2:
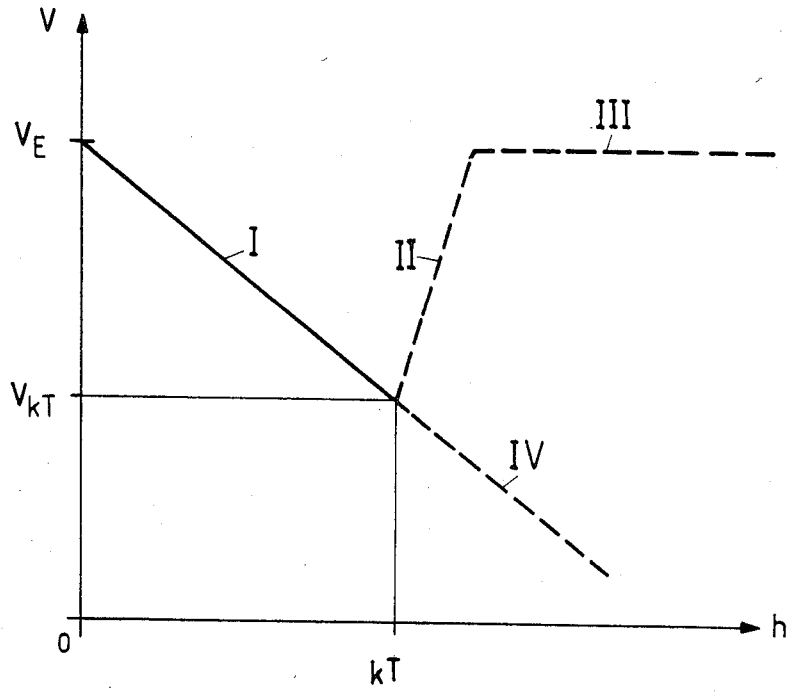
FIG. 2 is a plot of the volume V of the compression space as a function of the stroke h of the movable contact member.

Similarly, and as illustrated in FIG. 2, the volume V of the compression chamber 13 varies as a function of the stroke h of the contact member 4. In the make-position, with a stroke of 0, the compression chamber 13 still has a volume $V_E$. With increasing stroke h, the volume V of the compression chamber 13 decreases (curve section I) and, on separation of the sparking contacts 3 and 6 (stroke KT), the volume is reduced to the volume $V_{KT}$. At the same time, the pressure of the insulating gas present in the compression chamber 13 will have increased correspondingly.

If the contacts are then separated in the presence of large currents which are to be switched off, the switching arc blocks the nozzle orifices of the sparking contacts 3 and 6 during the high-current phase, and the pressure of the insulating gas present in the compression chamber 13, due to heating effects, is considerably increased. Above a given, presettable pressure value of the insulating gas present in the compression chamber 13, in the range of, for example, 0.5–1 bar higher than the pressure value of the insulating gas in the make-position, the piston 15 is displaced downwards and against the force of the spring 17. With the increased gas pressure, the compression chamber 13 is thus enlarged (curve section II in FIG. 2) until its volume remains constant (curve section III) due to the piston 15 which strikes the stop 19. When the current approaches the zero-crossing point, the pressure falls again, since the switching arc frees again the orifices of the sparking contacts 3 and 6. The maximum volume $V_E$ of the compression chamber 13 is then available for blasting the arc zone located between the two sparking contacts 3 and 6. In view of the large contemplated currents to be switched off, the circuit breaker according to the present invention therefore behaves like an arrangement in which the quenching gas is stored in a chamber of constant volume. The drive requires only the force necessary for tensioning the spring 17, which force is approximately of the same order of magnitude as the force necessary for building up the pressure of cold gas in the compression chamber 13.

If the contacts are then separated during the presence of lower currents, the force of the insulating gas, which has been only slightly heated by the switching arc, is insufficient for building up an adequate pressure in the compression chamber 13 for displacing the piston 15. After the separation of the contacts, the volume $V_{KT}$ will decrease further (curve section IV in FIG. 2). Therefore, for switching lower currents which are to switched off, the circuit breaker according to the invention therefore operates like a blast-piston circuit breaker. In this case, the drive must supply only the force necessary for compressing the insulating gas provided in the compression chamber 13. This force is small, because the insulating gas flows required for successfully blasting the arcs of small currents are low.

In the embodiment of the gas-blast circuit breaker of the invention according to FIG. 3, the shoulder 18 is fitted to the contact tube 8 instead of the housing 14. The force of the spring 17 is absorbed only by the contact tube 8. On breaking large currents, the force of the piston 15, which is moved after the separation of the sparking contacts 3 and 6, due to the heating by the switching arc, is therefore transmitted via the spring 17 to the contact tube 8. Thereby, the spring 17 is tensioned and the driving thereof is therefore facilitated.

In the embodiment according to FIG. 4, the piston 15 is slidably mounted in a cylinder 20, in a sealing fashion. The cylinder 20 is connected in a suitable manner to a cylinder bottom 21 which is fixed to the contact member 4 and through which the channel 10 passes, extending into the compression chamber 13. In the make-position (right-hand half of FIG. 4), the piston 15 is fixed by a stop 22 supported by the housing 14. The stop 22 is mounted, for example, by means of a rod 23 which passes through in sealing fashion the piston 15 and of which the end remote from the stop 22 is mounted on a shoulder 24 fixed to the housing 14.

When large currents are interrupted, the piston 15 is removed from the stop 22 against the force of the spring 17, after separation of the sparking contacts 3 and 6, as in the embodiments described above. In this case, it temporarily assumes the position shown, in dashed lines, on the left-hand side of FIG. 4. Analogously to the embodiment according to FIG. 3, the drive of the contact member 4 is, in this circuit breaker also, considerably relieved when large currents are broken. Furthermore, this circuit breaker also has the advantage that, due to the use of a cylinder connected to the contact member 4, the use of one additional piston is saved and the compression chamber 13 can be designed independently of the housing 14.

We claim:

1. Gas-blast circuit breaker comprising two contact members which are movable relative to one another and each having a respective sparking contact, a cylindrical compression chamber having a variable volume which changes based on the movement of the contact members, the chamber being filled with pressurized gas, one end face of said chamber containing an end of a channel leading to said respective sparking contact, the other end face thereof being bounded by a piston which is displaceable along a cylinder axis associated with the compression chamber, a tensioned spring below said piston, said piston being subjected to the action of said tensioned spring, the piston interacting with a fixed stop which is arranged in such a way that the movement of the piston which is subjected to the action of the tension spring is blocked, below a predetermined first pressure value of the pressurized gas present in the compression chamber, against the movement of a given one of said contact members which moves upon the occurrence of a breaking operation in the circuit breaker.

2. Gas-blast circuit breaker according to claim 1, wherein the first pressure value is approximately equal to a pressurized gas pressure which is present in the compression chamber, when the respective sparking contacts are separated during a breaking operation, and is precompressed by the breaking movement.

3. Gas-blast circuit breaker according to claims 1 or 2, wherein the end of said tensioned spring, located remotely from the piston, is supported on the given movable contact member which is moved upon the occurrence of the breaking operation.

4. Gas-blast circuit breaker according to claims 1 or 2, wherein the end of said tensioned spring, located remotely from the piston, is supported on a fixed housing.

5. Gas-blast circuit breaker according to claims 1 or 2, further comprising a stop located on said given movable one of said contact members to block, above a second pressure value which is greater than the first pressure value of the pressurized gas present in the compression chamber, the movement of the piston in the direction of the movement of said given one of said contact which is moved upon the breaking operation.

6. Gas-blast circuit breaker according to claims 1 or 2, further comprising a cylinder connected to the given one of the movable contact members and wherein the compression chamber is bounded by the piston and the cylinder.

7. Gas-blast circuit breaker according to claims 1 or 2, further comprising a second piston connected to said given one of said movable contact members and a fixed cylindrical housing and wherein the compression chamber is bounded by the piston, the fixed cylinder housing and the second piston which is connected to the given movable contact member.

8. Gas-blast circuit breaker according to claim 3, further comprising a stop located on said given movable one of said contact members to block, above a second pressure value which is greater than the first pressure value of the pressurized gas present in the compression chamber, the movement of the piston in the direction of the movement of said given one of said contact which is moved upon the breaking operation.

9. Gas-blast circuit breaker according to claim 4, further comprising a stop located on said given movable one of said contact members to block, above a second pressure value which is greater than the first pressure value of the pressurized gas present in the compression chamber, the movement of the piston in the direction of the movement of said given one of said contact which is moved upon the breaking operation.

10. Gas-blast circuit breaker according to claim 3, further comprising a cylinder connected to the given one of the movable contact members and wherein the compression chamber is bounded by the piston and the cylinder.

11. Gas-blast circuit breaker according to claim 5, further comprising a cylinder connected to the given one of the movable contact members and wherein the compression chamber is bounded by the piston and the cylinder.

12. Gas-blast circuit breaker according to claim 3, further comprising a second piston connected to said given one of said movable contact members and a fixed cylindrical housing and wherein the compression chamber is bounded by the piston, the fixed cylinder housing and the second piston which is connected to the given movable contact member.

13. Gas-blast circuit breaker according to claim 4, further comprising a second piston connected to said given one of said movable contact members and a fixed cylindrical housing and wherein the compression chamber is bounded by the piston, the fixed cylinder housing and the second piston which is connected to the given movable contact member.

14. Gas-blast circuit breaker according to claim 5, further comprising a second piston connected to said given one of said movable contact members and a fixed cylindrical housing and wherein the compression chamber is bounded by the piston, the fixed cylinder housing and the second piston which is connected to the given movable contact member.

* * * * *